United States Patent [19]

Sakai et al.

[11] Patent Number: 4,848,072

[45] Date of Patent: Jul. 18, 1989

[54] METHOD FOR PRODUCING SPUN YARNS

[75] Inventors: Shoji Sakai, Nagaokakyo; Akio Matsushima, Kyoto, both of Japan

[73] Assignee: Murata Kikai Kabushiki Kaisha, Kyoto, Japan

[21] Appl. No.: 166,196

[22] Filed: Mar. 10, 1988

[30] Foreign Application Priority Data

Mar. 16, 1987 [JP] Japan ..... 62-60406

[51] Int. Cl.[4] ..... D02G 1/16; D02G 3/04; D02G 3/36

[52] U.S. Cl. ..... 57/261; 57/87; 57/5

[58] Field of Search ..... 57/5, 12, 19, 87, 90, 57/261, 279, 315, 350

[56] References Cited

U.S. PATENT DOCUMENTS

| | | | |
|---|---|---|---|
| 1,305,540 | 6/1919 | Hanscom et al. | 57/87 |
| 3,822,543 | 7/1974 | Edagawa et al. | 57/315 X |
| 3,851,455 | 12/1974 | Jozwicki et al. | 57/5 X |
| 4,051,756 | 10/1977 | Bognar et al. | 57/87 X |
| 4,253,297 | 3/1981 | Pacholski et al. | 57/5 |

*Primary Examiner*—Donald Watkins
*Attorney, Agent, or Firm*—Spensley Horn Jubas & Lubitz

[57] ABSTRACT

A method for producing a spun yarn from staple fiber sliver by supplying an additional yarn of a different nature to the staple fiber sliver while drafting same, and imparting twists thereto by the use of an air injection nozzle. The supply of the additional yarn is started after arrival of the staple fiber sliver at the air injection nozzle.

20 Claims, 7 Drawing Sheets

METHOD FOR PRODUCING SPUN YARNS

FIELD OF THE INVENTION

The present invention relates to a method for producing spun yarns including an additional yarn.

RELATED ART STATEMENT

Applicant previously filed a patent application concerning an apparatus for producing spun yarns in which a drafting mechanism and an air injecting nozzle are located along a path of travel of staple fiber sliver, and a yarn outlet end of a yarn guide member which supplies an additional yarn of a nature different from the staple fiber sliver is located in an arbitrary position in the path of the staple fiber sliver. The spun yarns produced by this apparatus have various staple fibers intermixed with a yarn of a different nature to impart thereto strength along with high moisture absorptivity or other properties which are suitable for sports wears or to permit to produce cloth of unique designs by weaving such spun yarns. In addition to these purposes, it is expected that they can find a wide range of applications.

In the production of the above-mentioned spun yarns, smooth operation of the apparatus is sometimes jeopardized by error in controlling the timings of starting supplies of the staple fiber sliver and the additional yarn. This is because, for example, if the start of supply of the staple fiber sliver is preceded by the start of supply of the additional yarn, the latter is apt to be suctioned into a fly removing pipe without intertwining with the staple fiber sliver.

OBJECT AND SUMMARY OF THE INVENTION

It is an object of the present invention to provide a method for producing spun yarns whereby securely entwining an additional yarn with a staple fiber sliver and ensuring smooth operation.

In accordance with an embodiment of the present invention, there is provided a method for producing a spun yarn from staple fiber sliver by supplying an additional yarn of a different nature to the staple fiber sliver while drafting same, and imparting twist thereto by the use of an air injection nozzle, characterized in that the method comprises: starting supply of the additional yarn after arrival of the staple fiber sliver at the air injection nozzle; and starting supply of compressed air for feeding the yarn to the staple fiber sliver after releasing clamp of the yarn.

On starting production of a spun yarn, for example, on starting knotting, firstly sliver of staple fiber is fed to a drafting mechanism, and, after the staple fiber sliver past the drafting mechanism has reached an air injection nozzle, clamp of the additional yarn is released and compressed air is supplied to start supply of the yarn. When starting supply of the additional yarn, the staple fiber sliver is already running along its path of travel including the drafting mechanism and the air injection nozzle, so that the leading end of the additional yarn is securely entwined around the staple fiber sliver and thereby led into the air injection nozzle.

DETAILED DESCRIPTION OF EMBODIMENTS

The method for producing a spun yarn according to an embodiment of the invention is hereafter described together with an embodiment of apparatus adopted for carrying out the method of the invention.

Figure 1:
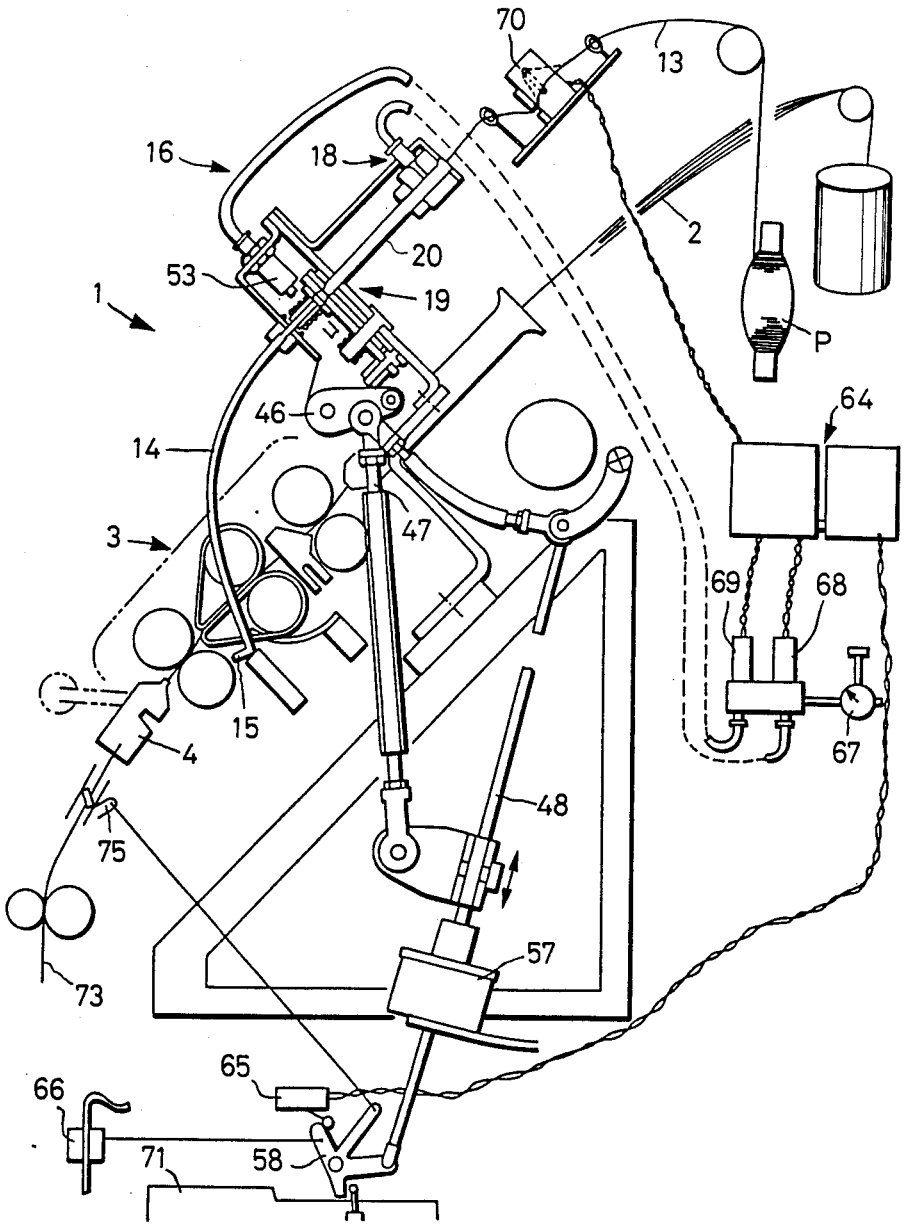
FIG. 1 is a schematic front view of an example of spun yarn producing apparatus, employed for carrying out the method of the invention.
Figure 2:
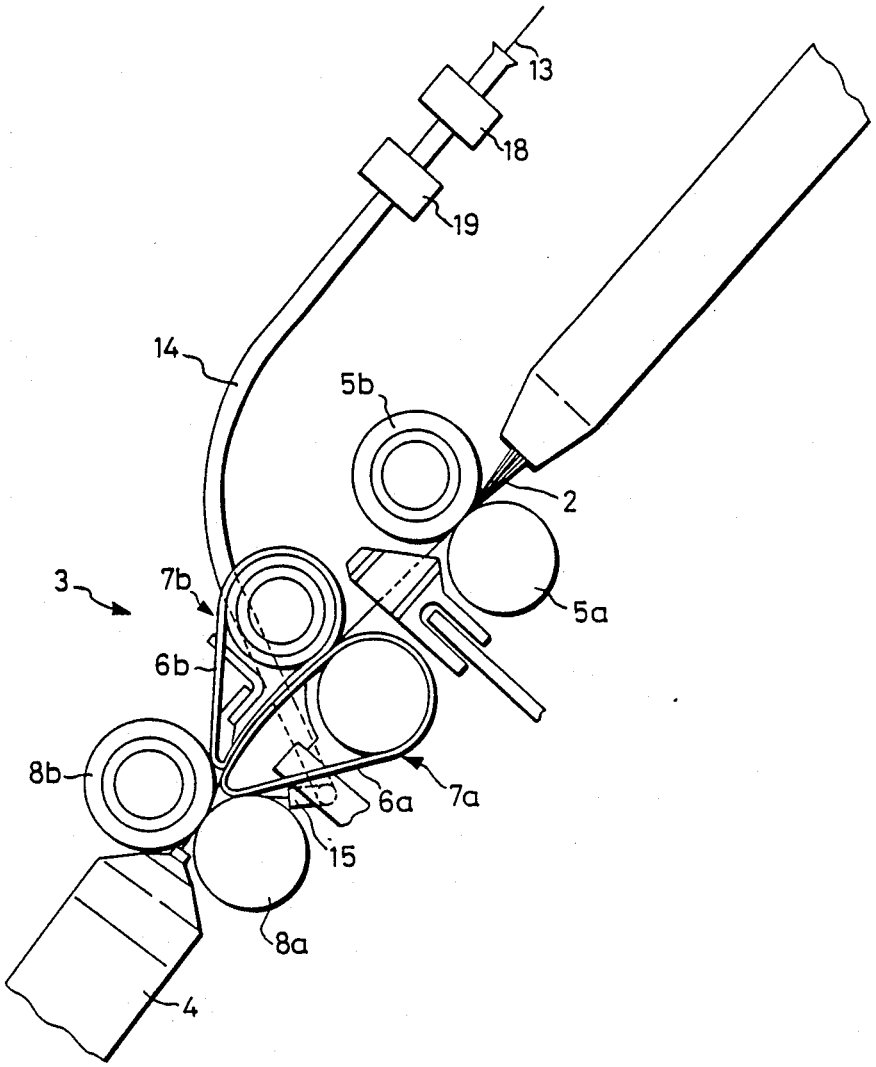
FIG. 2 is a fragmentary front view showing on an enlarged scale part of a draft mechanism.

The spun yarn producing apparatus 1 includes an additional yarn feeder on a pneumatic spinning machine, and has its major components and control mechanism arranged as schematically shown in FIG. 1.

The pneumatic spinning machine has a spinning unit U located along a path of staple fiber sliver, including a drafting mechanism 3 and an air injection nozzle. The draft mechanism 3 draws non-twisted staple fiber sliver to a predetermined thickness, and includes paired back rollers 5*a* and 5*b*, middle rollers 7*a* and 7*b* with aprons 6*a* and 6*b*, and paired front rollers 8*a* and 8*b*.

Figure 3:
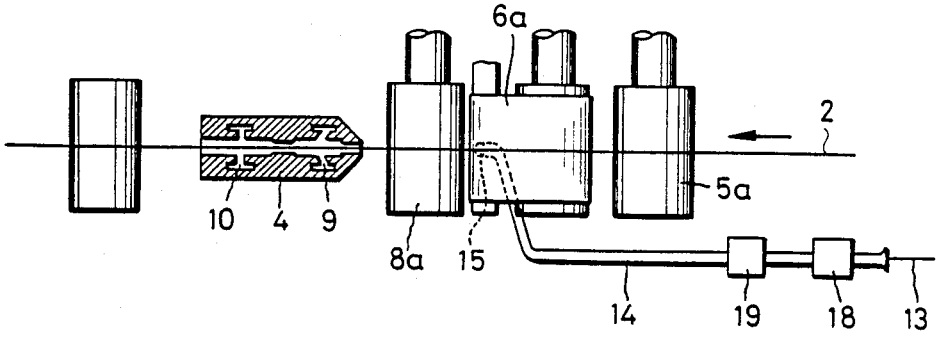
FIG. 3 is a plan view of the same mechanism.
Figure 4:
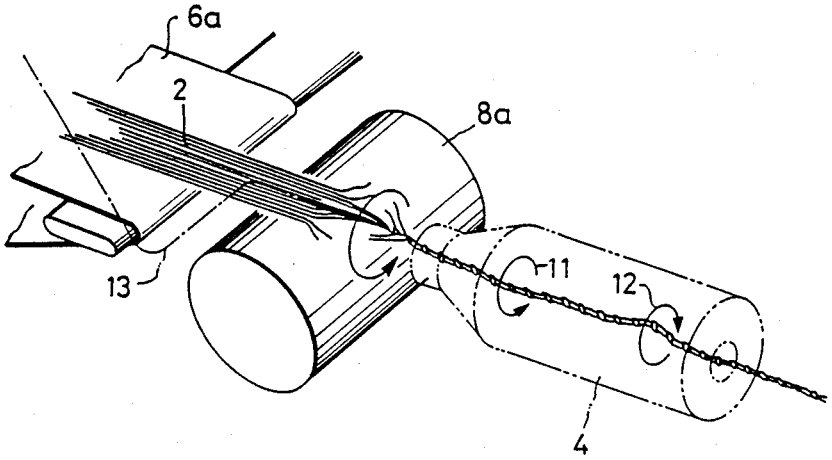
FIG. 4 is a perspective view showing the spinning condition of a staple fiber sliver which has been led into an air injection nozzle past the draft mechanism.

As shown particularly in FIG. 3, air injection nozzle 4 is internally provided with first and second nozzles 9 and 10 which are located successively in that order in the travel direction of the staple fiber sliver 2 to send out compressed air streams 11 and 12 toward the staple fiber sliver as shown in FIG. 4. Located below the apron 6*a* between the front roller 8*a* and middle roller 7*a* is an outlet end 15 of a yarn guide 14 which supplies to the staple fiber sliver 2 a filamental finished yarn 13 of fiber different from the staple fiber sliver, for example, a false twist yarn of polyester filaments. Although a filamental finished yarn is employed as an additional yarn different from the staple fiber sliver, it is shown for the sake of convenience and not for any limitative reason.

Figure 5:
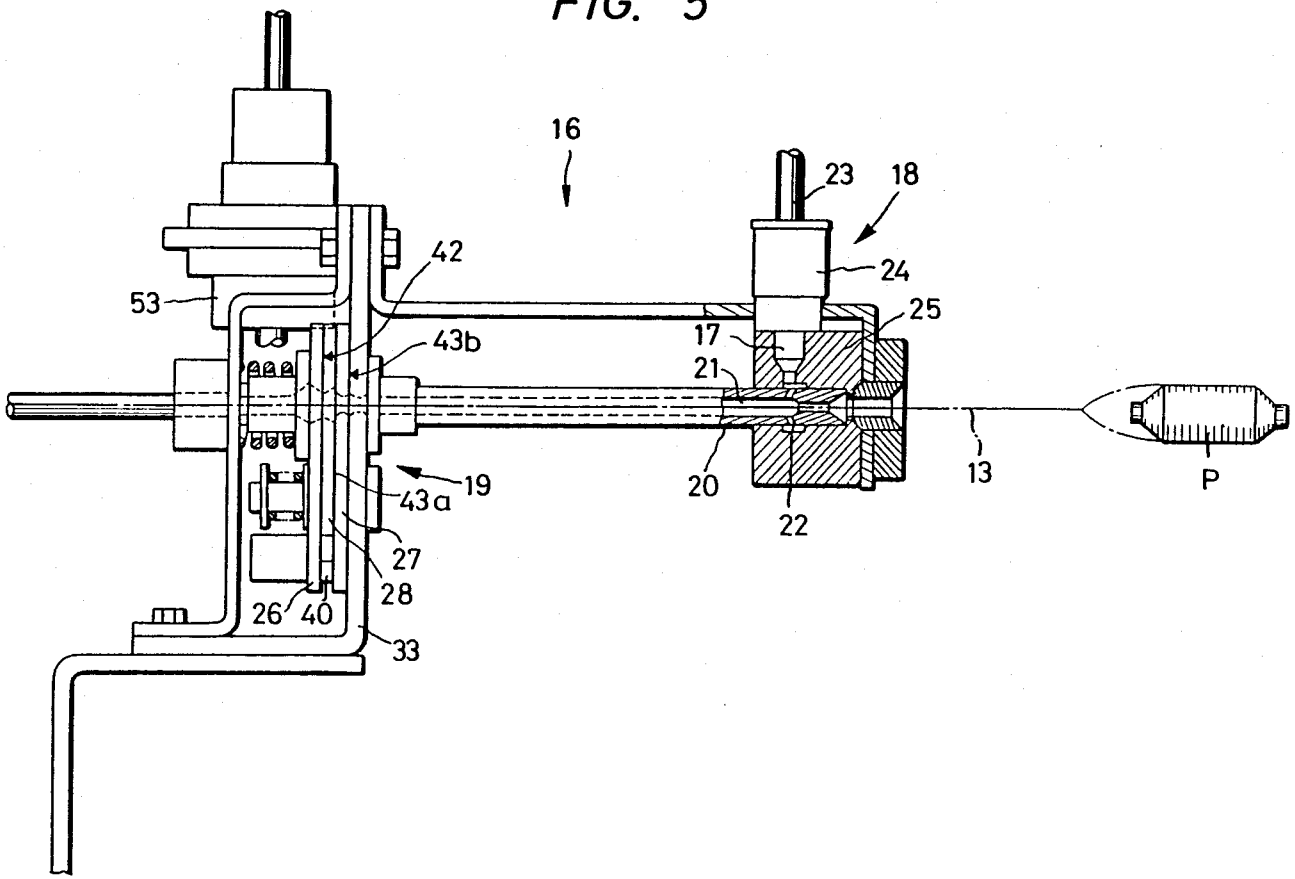
FIG. 5 is a partly sectioned front view of a feed stop mechanism for the additional thread.

As shown in FIG. 5, a yarn feed stopper 16 for the filamental finished yarn 13 includes a yarn feed mechanism 18 which is arranged to positively send out a finished yarn 13 withdrawn from a feed yarn package P upon start of the yarn feed, a yarn cutting/gripping mechanism 19 for stopping feed of the finished yarn 13 at the time of yarn breakage in the spinning section, namely, in the draft mechanism 3 or air injection nozzle 4 or at the time of full package, and a pipe 20 for guiding the finished yarn 13 to a predetermined feed position of the draft mechanism 3.

More specifically, the yarn feed mechanism 18 includes as its major components a compressed air nozzle 22 which is formed in the center bore 21 of the pipe 20 slantingly toward the path of travel of the yarn, a compressed air feed pipe 23 for supplying compressed air to the air nozzle 22, and an electromagnetic valve 24. Compressed air is spurted into the air nozzle 22 through a part 17 which is formed in a bracket 25 thereby positively sending to the draft mechanism 3 the leading end of the yarn which has been withdrawn from the feed package P. The cutting/gripping mechanism 19 for the finished yarn 13 is located in a position ensuing the pipe 20.

Figure 7:
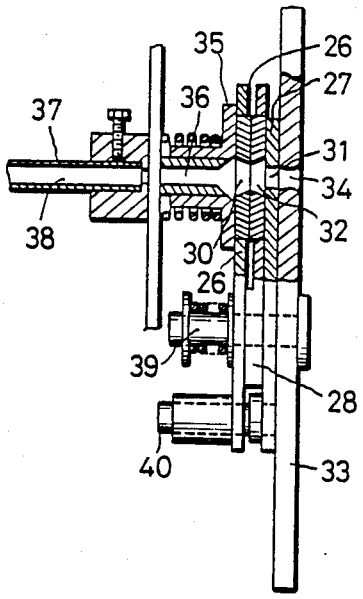
FIG. 7 is a partly sectioned front view of a yarn cutter/gripper.

The yarn cutting/gripping mechanism 19 is constituted by a couple of movable members 26 and 27, a fixed member 28 provided between the movable members 26 and 27, and a drive mechanism 29 for the movable members 26 and 27. The movable and fixed members 26 to 28 are provided with holes 31 to 32, respectively, which form an open thread passage in normal travelling condition of the yarn. As shown in FIG. 7, they are supported in positions in alignment with a hole 34 provided in a frame 33, a center hole 36 provided in a pressing bush 35 of the movable member and a center hole 38 of the pipe 37 at a joint portion.

The above-mentioned movable members 26 and 27 are rotatably supported by a shaft 39, and a pin 40 is connected between them so that they can be turned integrally with each other. The fixed member 28 is supported on the shaft 39 as shown in FIGS. 6 and 7, and fixedly connected at one part to the frame 33 by a pin 41.

Figure 8:
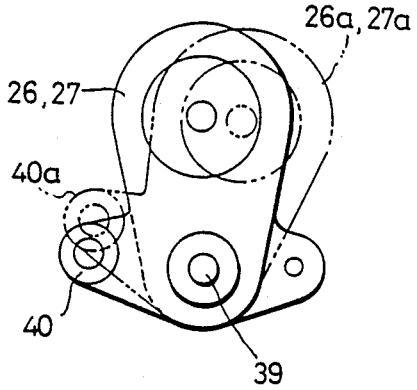
FIG. 8 is a side view of movable members.

Further, a cutter is formed by an end face of one of the movable members 26 and 27, namely, of the movable member 26 on the side of the draft mechanism 3 and a contacting surface 42 on the end face of the fixed member 28. On the other hand, a yarn clamper is formed by the other movable member, namely, the movable member 27 on the side of the yarn feed package P, a contacting surface 43*a* on the other end face of the fixed member 28 and a contacting surface 43*b* of the movable member 27 and the frame 33. Accordingly, as shown in FIG. 8, by turning the movable members 26 and 27 from the positions of solid line to the positions 26*a* and 27*a* indicated by two-dot chain line to bring the holes 30 and 31 of the movable members 26 and 27 into a position out of alignment with the hole 32 of the fixed member 28, the finished yarn 13 which is running through the pipe 20 as shown in FIG. 5 is cut by the contacting surface 42 between the movable and fixed members 26 and 28 and clamped by the contacting surfaces 43*a* and 43*b* between two of the fixed member 28, movable member 27 and frame 33. The slippery filamental finished yarn 13 is gripped at two different positions by secure clamps of the contacting surfaces 43*a* and 43*b* while the yarn end on the feeding side is retained by the cutting/gripping mechanism 19, in preparation for restart of yarn feed. The holes 30 and 36 of the movable member 26 and presser bush 35 are provided with chamfered edges which are diverged toward each other not to clamp the yarn. In this embodiment, the movable members 26 and 27 are provided on the opposite sides of the fixed member 28 as shown in FIG. 7, but it is of course possible to employ an arrangement where the outer members 26 and 27 are fixed and the intermediate member 28 is movable.

Figure 6:
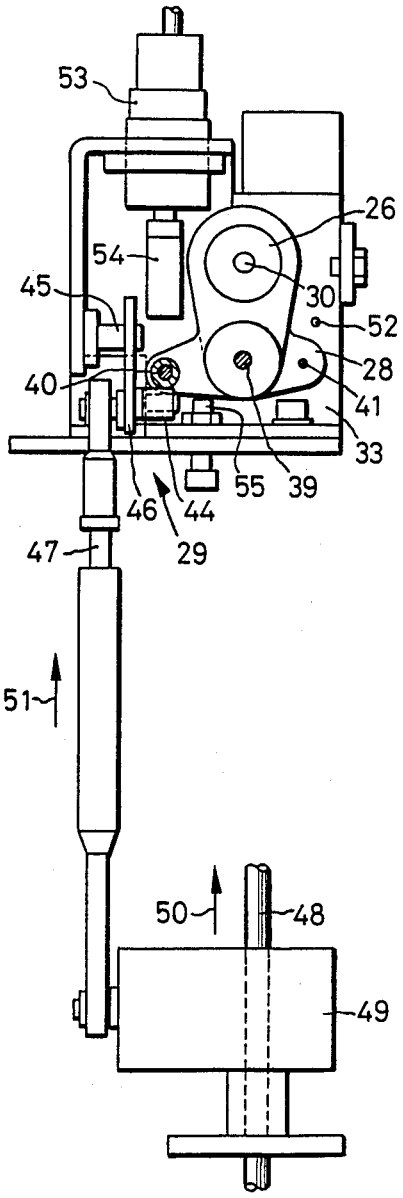
FIG. 6 is a side view of the same mechanism.
Figure 9:
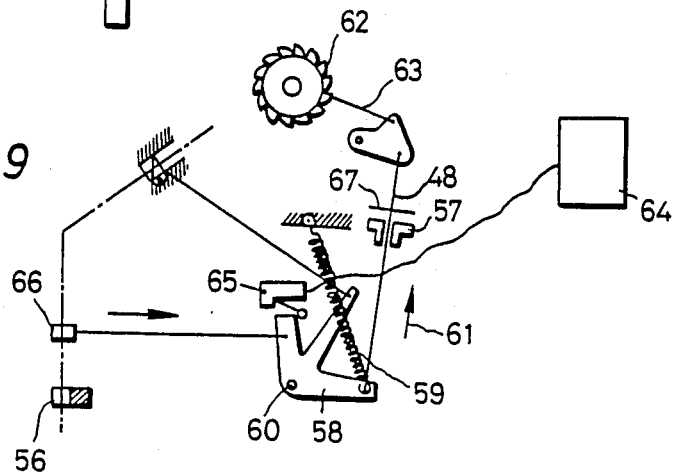
FIG. 9 is a schematic illustration of a drive mechanism for a solenoid rod.

Referring to FIGS. 6 and 9, the drive mechanism for the yarn cutting/gripping mechanism 19 is now explained. For turning the movable member 26 into the yarn cutting/gripping position, it is operated in relation with sliver feed stop motion which is actuated in response to a cut-off signal sent from the spinning unit U for removal of a defect in the spun yarn. More specifically, a pin 44 is provided on a lever 46 which is pivotally supported on a fixed shaft 45, for turning the movable member 26 clockwise about the shaft 39 in FIG. 6 by engagement with the pin 40 of the movable member 26. Connected to the lever 46 is one end of a rod 47 the other end of which is fixed through a joint bracket 49 to a solenoid rod 48 which is actuated by the above-mentioned yarn cut-off signal.

Therefore, as the solenoid rod 48 is moved in the direction of arrow 50 by the operation which will be described hereinlater, the rod 47 is pushed in the direction of arrow 51, turning the movable member 26 about the shaft 39 through the lever 46 and pin 44. Indicated at 52 is a stopper for the movable member. Namely, it determines the position of the movable member 26 when the latter is turned into the position 26*a* of two-dot chain line in FIG. 8.

Further, a cylinder 53 is provided for returning the movable member 26 to the initial position, i.e., to the yarn feeding position. When a piston rod 54 of th cylinder 53 is protruded from the position shown in FIG. 6, it is abutted against the pin 40*a* of the movable members 26 and 27 indicated by two-dot chain line in FIG. 8, pushing the pin 40*a* to turn the movable members 26 and 27 counterclockwise about the shaft 39 for return to the respective initial positions. Designated at 55 is a stopper for determining the positions of the movable members in the yarn feed position.

Referring to FIG. 9, there is schematically shown an operating mechanism for the above-mentioned solenoid rod 48. More specifically, indicated at 56 is a yarn clearer which serves to detect defects in the spinning yarn such as thick portions, thin portions, slabs and the like, turning off the solenoid 57 in response to a detection signal from the yarn clearer 56. The solenoid rod 48 is connected to an operating lever 58 which is biased by a spring 59 to turn counterclockwise about a shaft 60, so that the solenoid rod 48 is moved in the direction of arrow 61, and a ratchet wheel 62 for the back roller of the draft mechanism 3 is forcibly stopped by a stopper 63 to stop supply of the staple fiber sliver 2 to the back roller, while turning the movable members 26 and 27 to stop supply of the filamental finished yarn 13 and actuate a cutter 75 to cut the spun yarn 73.

The feed stop release mechanism includes a microswitch 65 which is located in the locus of clockwise rotation of the above-mentioned operating lever 58 and which is connected to a feed control mechanism 64 for the filamental finished yarn and to a clutch of the back rollers, and a push button 62 which is depressed to rotate the operating lever 58 clockwise thereby to turn on the switch 65.

Feed control mechanism 64 for the filamental finished yarn 13 controls supply of compressed air to the feed stop mechanism 16, and includes a first solenoid valve 68 located between the compressed air feed pipe 23 and a compressed air source 67, and a second solenoid valve 69 located between the compressed air source 67 and the cylinder 53, controlling supply of compressed air by opening and closing these two solenoid valves 68 and 69. Further, the feed control mechanism 64 is also connected to a microswitch 70 which is located in the path of travel of the filamental finished yarn 13 to detect termination, breakage and feed error of the filamental finished yarn 13.

Now, the method of the present invention is described on the basis of the above-described apparatus mainly with respect to the start of the spun yarn manufacturing process.

When a spindle is stopped, a knotter 71 runs to the spindle in stand-by state to start a knotting operation. During the stop of the spindle, the movable members 26 and 27 of the yarn cutting/gripping mechanism 19 are turned by rotation of the action lever 46 to clamp the filamental finished yarn 13, and the ratchet wheel 62 for the back roller of the draft mechanism 3 is forcibly stopped to suspend the feed of the staple fiber sliver 2.

Approximately one second after initiation of the knotting, the operating button 65 is switched on and simultaneously the operating lever 48 is turned clockwise in FIG. 1, pulling the solenoid rod 48 downwardly in the same figure and releasing the ratchet wheel 62 for the back rollers of the draft mechanism 3 to rotate the back roller to feed the staple fiber sliver to the draft mechanism 3. It takes about 15 seconds for the leading end of the staple fiber sliver to reach the air injection nozzle 4 past the draft mechanism 3.

Figure 11:
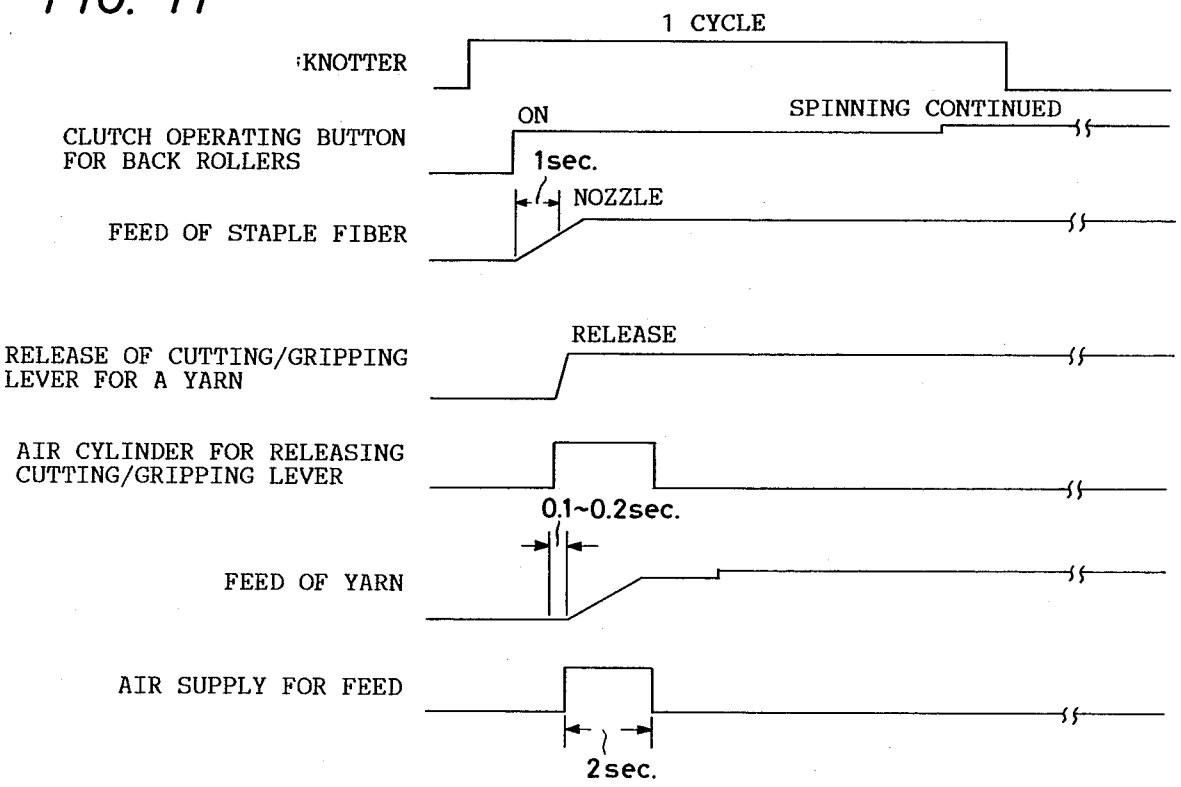
FIG. 11 is a timing chart in the initial stage of a spun yarn manufacturing process.

On the other hand, in response to turn-on of the operating button 65, the feed control mechanism 64 for the filamental finished yarn 13 opens the second solenoid valve 69 about one second after the restart of the back rollers to supply compressed air to the yarn cutting/-gripping mechanism 19, turning the movable members 26 and 27 to release the clamp on the filamental finished yarn 13. Further, the first solenoid valve 68 is opened about 0.1 to 0.2 second after opening the second solenoid valve 69 to send compressed air to the yarn feeder 18 for about 2 seconds. FIG. 11 is a timing chart of the operations from start of knotting to injection of compressed air for feed of the filamental finished yarn.

Figure 10:
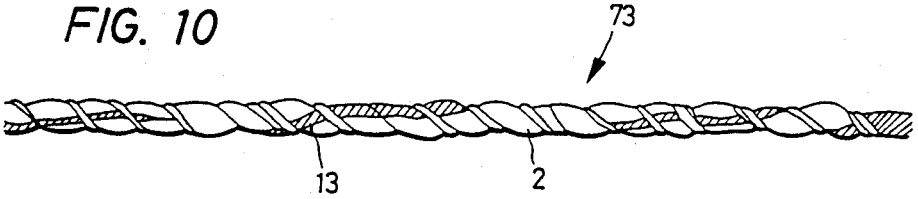
FIG. 10 is a fragmentary front view of a spun yarn.

In this manner, it is after the staple fiber sliver 2 has been suctioned into the air injection nozzle 4 past the draft mechanism that the filamental finished yarn 13 is sent out from the yarn outlet end 15 through the yarn guide 14. Therefore, the filamental finished yarn 13 is securely entwined with the staple fiber sliver 2, and then led into the air injection nozzle 4 to form a spun yarn 73. FIG. 10 illustrates part of a spun yarn produced by the method of the present invention.

According to the present invention, in the process of manufacturing a spun yarn by intertwining staple fiber sliver with an additional yarn of a nature different from the staple fiber sliver, the feed of the additional yarn is started at a time point after arrival of the stable fiber sliver at an air injection nozzle and after release of clamp, thereby securely entwining the additional yarn with the staple fiber sliver and ensuring smooth operation by eliminating the troubles which would otherwise be encountered in the production of spun yarns of that sort.

What is claimed is:

1. A method for producing a spun yarn from staple fiber sliver by supplying an additional yarn of different nature to the staple fiber sliver while drafting same, and imparting twist to the staple fiber sliver and the additional yarn by the use of an air injection nozzle having first and second nozzles for providing first and second air streams, respectively, directed in opposite directions to impart opposite directed twisting forces on the staple fiber sliver and the additional yarn, characterized in that said method comprises the steps of:

delivering said staple fiber sliver to said air injection nozzle; and starting the supply of said additional yarn after arrival of said staple fiber sliver at said air injection nozzle.

2. A method for producing a spun yarn from a staple fiber sliver by supplying an additional yarn to the staple fiber sliver while drafting same, and imparting twist to the staple fiber sliver and the additional yarn by the use of an air injection nozzle, in that said method comprises the steps of:

delivering said staple fiber sliver to said air injection nozzle; and starting the supply of said additional yarn after arrival of said staple fiber sliver at said air injection nozzle, wherein said step of starting comprises the steps of:

clamping said additional yarn;

releasing the clamping of said additional yarn; and starting a supply of compressed air to feed said additional yarn to said staple fiber sliver after releasing the clamping of said additional yarn.

3. An apparatus for producing a spun yarn from staple fiber sliver by supplying an additional yarn of different nature to the staple fiber sliver while drafting same, and imparting twist to the staple fiber sliver and the additional yarn by the use of an air injection nozzle, characterized in that said apparatus comprises:

a draft mechanism which includes paired back rollers, middle rollers with aprons and paired front rollers, and is located along a path of the staple fiber sliver;

an air injection nozzle which is internally provided with first nozzle and second nozzle which ejects a compressed air stream in opposite direction to the air stream in the first nozzle;

a yarn guide having an outlet end located between the front roller and middle roller and supplies to the staple fiber sliver the additional yarn; and a yarn feed stopper for the additional yarn.

4. The apparatus as claimed in claim 3, wherein said yarn feed stopper includes a yarn feed mechanism which is arranged to draw out the yarn from a package upon start of the yarn feed, a yarn cutting/gripping mechanism for stopping feed of the yarn at the time of yarn breakage or at the time of full package, and a pipe for guiding the yarn.

5. The apparatus as claimed in claim 4, wherein said yarn feed mechanism includes a pipe, a compressed air nozzle which is formed in the center bore of the pipe slantingly toward the path of travel of the yarn, a compressed air feed pipe for supplying compressed air to the air nozzle, and a valve arranged to control the supply of compressed air to the air nozzle.

6. The apparatus as claimed in claim 4, wherein said yarn cutting/gripping mechanism comprises a pair of movable members which are rotatably supported by a shaft and can be turned integrally with each other, a fixed member provided between the movable members, and a drive mechanism for the movable members, said movable and fixed members being provided with holes, respectively, which are positioned in alignment with each other to be a passage for the yarn on general yarn feeding.

7. The apparatus as claimed in claim 6, wherein a cutter is formed by an end face of one of the movable members on the side of the draft mechanism and a contacting surface on the end face of the fixed member while a yarn clamper is formed by the movable member on the side of the yarn feed package and a contacting surface on the another end face of the fixed member.

8. The apparatus as claimed in claim 7, wherein said yarn cutting/gripping mechanism is further provided with a frame having a through hole for the yarn abutting with the movable member at the feed package side so that the yarn is also clamped by the contacting surface between the movable member and the frame.

9. A yarn feeding system operable with both a drafting mechanism having a sliver running path and a pneumatic yarn twisting device arranged along the sliver running path, said yarn feeding system for feeding a yarn along a yarn running path to the sliver running path, said yarn feeding system comprising:

a yarn feeder arranged adjacent the yarn running path;

a first yarn guide arranged to guide the yarn fed by said yarn feeder into the sliver running path;

stopping means operable for stopping the feeding of yarn by said yarn feeder; and control means for selectively operating said stopping means.

10. A yarn feeding system as claimed in claim 9, wherein said yarn feeder comprises:

a second yarn guide arranged in communication with said first yarn guide; and a fluid ejector arranged to eject a fluid flow directed to force the yarn along said second yarn guide toward said first yarn guide.

11. A yarn feeding system as claimed in claim 9, wherein said stopping means comprises a yarn gripper arranged adjacent the yarn running path.

12. A yarn feeding system as claimed in claim 11, wherein said stopping means further comprises a yarn cutter arranged adjacent the yarn running path downstream from the yarn gripper.

13. A yarn feeding system as claimed in claim 9, wherein said stopping means comprises:

a stationary member having a first yarn passage through which the yarn is passed;

a first movable member having a second yarn passage through which the yarn is passed, said first movable member arranged adjacent said stationary member and being movable to a first position wherein said first yarn passage aligns with said second yarn passage, said first movable member being movable in a second position wherein said first and second yarn passages are misaligned.

14. A yarn feeding system as claimed in claim 13, wherein said stationary member has a first surface facing said movable member, said first movable member has a first surface facing said stationary member, and said first surface of said stationary member and said first surface of said first movable member being arranged to clamp the yarn therebetween upon said first movable member being moved to said second position.

15. A yarn feeding system as claimed in claim 14, wherein said stationary member has a second surface, and wherein said stopping means further comprises a second movable member having a third yarn passage through which the yarn is passed, said second movable member having a first surface arranged adjacent said second surface of said stationary member, said second movable member being movable to a first position wherein said first yarn passage aligns with said third yarn passage, said second movable member being movable to a second position wherein said first and third yarn passages are misaligned, said second movable member having a cutting edge arranged to traverse and cut the yarn upon said second movable member being moved to said second position.

16. A yarn processing system for producing a yarn from a sliver located in a sliver running path and a component yarn, said yarn processing system comprising:

a drafting mechanism having a first pair of rollers and a second pair of rollers arranged along the sliver running path;

a pneumatic twisting device arranged along the sliver running path downstream from said drafting mechanism;

a yarn guide arranged to guide the additional yarn to the sliver running path between said first and second pairs of rollers;

a yarn feeding means for selectively feeding the component yarn along said yarn guide; and control means for controlling the selected feeding of the component yarn.

17. A yarn processing system as claimed in claim 16, further comprising:

a defect detecting means, arranged downstream from said pneumatic twisting device, for detecting yarn defects;

wherein said control means is responsive to said defect detecting means and comprises stopping means for stopping the feeding of the component yarn upon detection of a yarn defect.

18. A yarn processing system as claimed in claim 17, wherein:

the component yarn is located along a yarn running path;

said stopping means comprises a yarn gripping device arranged adjacent the yarn running path and a yarn cutting device arranged adjacent the yarn running path downstream from the yarn gripping device.

19. A yarn processing system as claimed in claim 16 wherein:

the component yarn is located along a yarn running path; and said control means comprises a yarn gripping device arranged adjacent the yarn running path and a yarn cutting device arranged adjacent the yarn running path downstream from the yarn gripping device.

20. A method of operating a drafting device and a twisting device to produce a yarn from a sliver and a component yarn, said method comprising the steps of:

feeding the sliver along a sliver running path through the drafting device;

converging the sliver width to a converged width sliver at a converging portion of the sliver running path;

feeding the converged width sliver through a pneumatic twisting device; and feeding the component yarn into the converging portion of the sliver path following said step of feeding the converged with sliver.

* * * * *